United States Patent [19]

Barrash

[11] Patent Number: 4,582,215

[45] Date of Patent: Apr. 15, 1986

[54] CONTAINER CARRIER

[75] Inventor: Marshall J. Barrash, Atlanta, Ga.

[73] Assignee: The Coca-Cola Company, Atlanta, Ga.

[21] Appl. No.: 690,560

[22] Filed: Jan. 11, 1985

[51] Int. Cl.[4] ..... A47J 45/06; B65D 25/28

[52] U.S. Cl. ..... 220/94 R; 206/150; 215/100 A; 294/31.2; 294/87.2

[58] Field of Search ..... 220/94 R; 215/100 A; 206/150; 294/31.2, 87.2

[56] References Cited

U.S. PATENT DOCUMENTS

| | | | |
|---|---|---|---|
| D. 184,315 | 1/1959 | Jennings . | |
| D. 187,500 | 3/1960 | Jennings . | |
| 1,596,076 | 8/1926 | Clancy . | |
| 3,000,527 | 9/1961 | Jennings . | |
| 3,194,857 | 7/1965 | White . | |
| 3,220,591 | 11/1965 | Hidding | 215/100 A |
| 3,232,422 | 2/1966 | Whyte | 294/87.2 X |
| 3,311,252 | 3/1967 | Swartwood et al. | 294/31.2 X |
| 3,463,536 | 8/1969 | Updegraff et al. | 215/100 A X |
| 3,594,891 | 7/1971 | Cunningham . | |
| 3,612,595 | 10/1971 | Updegraff et al. | 215/100 A X |
| 3,620,410 | 11/1971 | Griese, Jr. | 220/94 R |
| 3,651,978 | 3/1972 | White . | |
| 3,653,610 | 4/1972 | Owen | 215/100 A X |
| 3,680,905 | 8/1972 | Klygis | 215/100 A X |
| 4,033,457 | 7/1977 | Weaver | 294/87.2 X |
| 4,090,729 | 5/1978 | Erickson . | |

FOREIGN PATENT DOCUMENTS

| | | | |
|---|---|---|---|
| 911277 | 11/1962 | United Kingdom | 294/31.2 |

*Primary Examiner*—Allan N. Shoap

[57] ABSTRACT

A plastic die cut container carrier comprising an endless band having a handle and a carrier ring with an elliptical opening therein, the carrier ring being connected to the handle by a pair of arms which connect to the carrier ring adjacent the ends of the minor axis of the elliptical opening. The handle includes a longitudinal groove to facilitate folding and is connected to the carrier ring by a break-away tab. The design equalizes stress risers at the critical load points.

2 Claims, 4 Drawing Figures

CONTAINER CARRIER

BACKGROUND OF THE INVENTION

1. Field of the Invention

This invention relates to carriers for relatively large beverage bottles and in particular to a die cut plastic carrier for such containers.

2. Description of the Prior Art

Container carriers made from die cut plastic material are known as shown, for example, in U.S. Pat. Nos. 3,680,905 and 3,653,610.

It is the object of the present invention to provide an improved die cut plastic carrier.

It is another object of the present invention to provide a method for carrying a relatively large, heavy beverage bottle.

It is a further object of the present invention to provide an improved combination container and carrier.

SUMMARY OF THE INVENTION

A container carrier die cut from plastic sheet material and comprising an endless band including a carrier ring connected to a handle by a pair of arms. The carrier ring has an elliptical opening therein and the arms are connected to the carrier ring adjacent the ends of the minor axis of the elliptical opening. The handle includes a groove to facilitate bending of the handle to provide a smooth and enlarged surface area for the fingers. A break-away connecting tab connects a mid-portion of the handle with the carrier ring. The design equalizes stress risers or concentrators at the critical load points in the carrier.

BRIEF DESCRIPTION OF THE DRAWINGS

The present invention will be more fully understood from the following detailed description when read in connection with the attached drawings wherein like reference numerals refer to like elements and wherein.

DETAILED DESCRIPTION OF THE PREFERRED EMBODIMENTS

Figure 1:
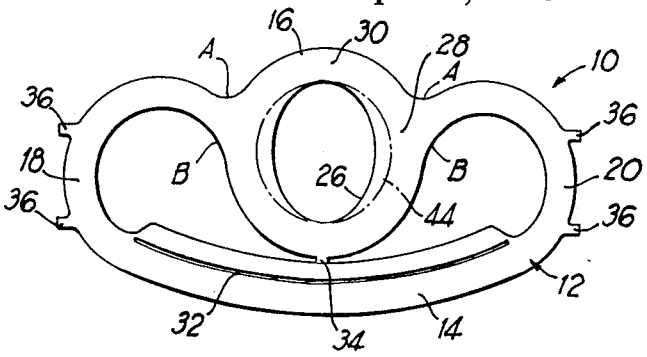
FIG. 1 is a top plan view of the carrier according to a preferred embodiment of the present invention.

With reference now to the drawings, FIG. 1 shows a container carrier 10 according to the present invention including an endless band 12 having a handle 14, a carrier ring 16 and a pair of connecting arms 18 and 20. The carrier ring 16 has a generally circular outer circumference and an elliptical opening 26 therein providing a wider wall portion 28 along the short axis of the elliptical opening 26 and a narrower wall portion 30 along the long axis.

The handle 14 includes a debossed groove 32 which allows the handle to fold when gripped by the fingers when carrying a container to provide a larger, smooth surface area and therefore a more comfortable handle. The handle 14 is connected at about the middle thereof to the carrier ring 16 by a break away connecting tab 34 which easily breaks when the handle is grasped in lifting a container to which the carrier 10 is connected.

Figure 2:
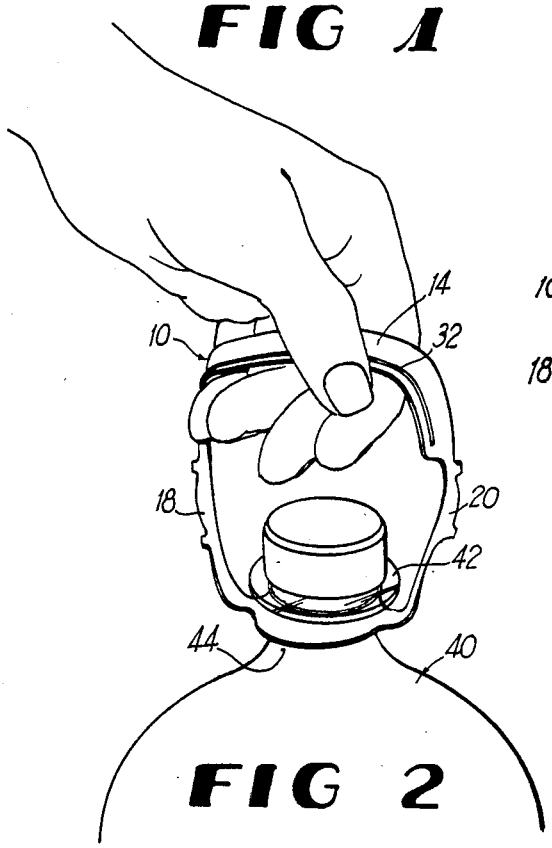
FIG. 2 is a perspective view of the carrier of FIG. 1 as attached to a beverage bottle and as it appears when in use to carry the bottle.

FIG. 2 shows a bottle 40 such as a PET soft drink bottle having a support ring 42 or grip feature above a cylindrical neck 44. The container carrier 10 is manually or automatically positioned in place on the bottle 40 by moving the carrier ring 16 down over the top of the bottle and over the support ring 42 and onto the neck 44 of the bottle 40 just below the support ring 42. In so positioning the carrier ring 16 on the bottle 40, the entire carrier ring 16 is stretched to fit over the ring 42 and the carrier ring is stretched along its minor axis when it is in its final position on the neck. The long axis of the elliptical opening 26 is approximately identical to the diameter of the neck 44, and the short axis is substantially smaller. The carrier ring is primarily radially oriented and the arms are at 90° thereto and longitudinally oriented in the carrying position of the carrier 10.

The carrier 10 can be made in any desired manner and from any suitable material. It is preferably die cut from a plastic sheet such as a 0.020 inch thick sheet of a resilient, elastic, deformable plastic material such as a semicrystalline polymer, one example of which is polyethylene. A plurality of the carriers can be arranged in rows and can be arranged in reversed position in adjacent rows on a large plastic sheet to minimize scrap during the die cutting operation. The adjacent carriers in a single row are preferably connected to each other by one or more easily broken tabs 36, so they can be fed in a strip and then detached for application to a bottle in a filling line. The tab 34 keeps the carrier 10 compact until time for use when the tab 34 breaks easily as the handle 14 is grasped to lift the bottle. The tab 34 allows the carrier to be easily handled, stacked, stored and transported.

The carrier 10 is placed in position on the bottle manually or by use of any known automatic machinery for stretching the carrier ring 16 momentarily while moving it over the support ring 42 and onto the neck 44. While the long dimension of the elliptical opening 26 is about the same as the diameter of the neck 44, the small diameter of the opening 26 is much smaller. Thus, the carrier ring 16 is already stretched in the direction of the short axis of the opening 26 when it is in place on the bottle 40. This prevents the ring 16 from stretching any further when the carrier 10 is in use and the load of the bottle, and thus prevents such further stretching of the ring 16 as would allow the bottle to fall out of the carrier. The ring 16 needs to be stretchable to install it, but it can not be so stretchable as to allow the bottle to fall out of it. The arms 18 and 20 are connected to the ring 16 along the narrow axis of the elliptical opening so that the forces applied to the ring 16 during carrying of the bottle 40 will not be such as to stretch the ring and allow the bottle to fall out of it. The stretching forces used to install the ring 16 on the neck 44 are greater than the forces on the ring during use thereof to carry the bottle 40.

The neck 44 diameter can be about 1.4 inches which is also the long diameter or major axis of the elliptical opening 26. The overall length of the carrier 10 as die cut is about 5.4 inches and the overall width about 2.6 inches. The support ring 42 can have a diameter of about 2 inches. The minor axis of the elliptical opening can have a length of about 1.1 inch. The debossed groove can be formed during die cutting to provide a hinge line.

Figure 3:
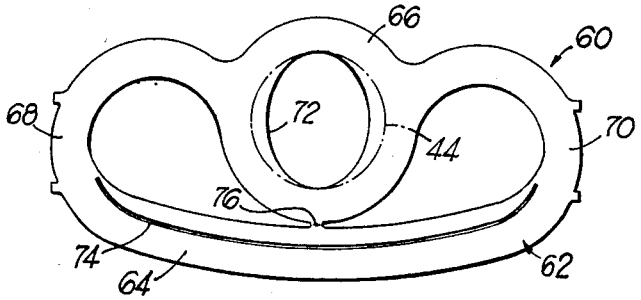
FIG. 3 is a top plan view of a carrier according to another embodiment of the present invention.

FIG. 3 shows another embodiment of the present invention of a container carrier 60 having an endless band 62 including a handle 64, a carrier ring 66 and connecting arms 68 and 70. The carrier ring 66 includes an elliptical opening 72. The handle 64 includes a debossed groove 74, and a break-away connecting tab 76 connects the handle to the carrier ring. The difference between the container carrier 60 and the container carrier 10 of FIG. 1 is that the handle 64, has a width that more gradually merges with the connecting arms 68 and 70 than in the container carrier 10 of FIG. 1.

Figure 4:
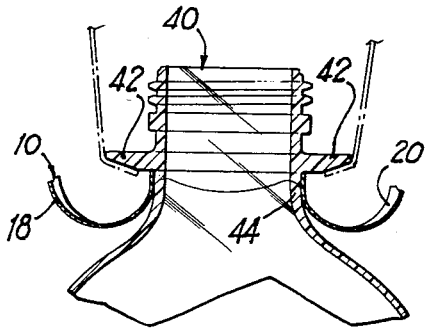
FIG. 4 is an enlarged, partial, side elevation view showing the carrier ring on the neck of the bottle.

FIG. 4 is a cross-sectional view through the carrier ring 16 and the neck 44 and support ring 42 of the bottle 40 as shown in FIG. 2 taken along the minor axis of the elliptical opening 26. FIG. 4 shows in solid lines the carrier ring 16 and part of the arms 18 and 20 as they are before the handle 14 is grasped, and shows in phantom lines the location of the carrier ring and arms when the carrier 10 is used to carry the bottle. It is noted that the ring 16 is oriented in a radial plane transverse to the bottle and the arms in a vertical plane. This provides unusual and different stresses on the critical areas of the carrier 10 compared to a situation wherein both members 16 and 18–20 are in the same plane. The elastic nature of the material of the carrier causes the ring 16 to shrink against the neck 44 in the direction of the minor axis of the opening 26 so an inner portion of the ring material is cylindrical against the wall of the neck 44 (and can extend either up or down). When the carrier 10 is used to carry the bottle 40, the ring stretches somewhat along the minor axis usually pulling the inner edge away from the neck wall but leaving sufficient material below the support ring 42 so the bottle cannot fall out.

In FIG. 1, the carrier 10 employs in the connection area of said arms to said carrier ring a smaller radius of curvature A and a relatively larger radius of curvature at B to equalize the stress at this critical area and to shift some of the stress to the outside (upper in FIG. 1) edge. This eliminates some of the stress risers at this point. Some elastic deformation will occur here in use but this design will minimize plastic deformation and will eliminate failure.

The change in shape of the handle end portions in FIG. 3 eliminates an edge that has to absorb much stress and instead shifts this stress broadly to the width of the handle rather than just to an edge thereof.

It will be apparent that various alterations, modifications and changes can be made in the embodiments described herein without departing from the spirit and scope of the present invention as defined in appended claims. For example, different materials and shapes can be used.

I claim:

1. A container carrier comprising:

(a) a flat, die cut plastic carrier comprising an endless band;

(b) said endless band including a carrier ring, a handle having an inner edge facing said carrier ring, and a pair of arms connecting said handle to said carrier ring;

(c) said carrier ring having an elliptical opening therein having a major axis with a length of about 1.4 inches and a minor axis with a length of about 1.1 inches;

(d) said arms being connected to said carrier ring adjacent to the ends of the minor axis of said elliptical opening, the connection area of said arms to said carrier ring including an inner edge facing said handle and merging into the handle inner edge, and including an outer edge facing away from said handle, and wherein the radius of curvature of said inner edge is substantially greater than that of said outer edge, to equalize stress risers in said connection area;

(e) said handle having a groove extending along substantially its entire length; and (f) a break-away connecting tab connecting a mid-portion of said handle to said carrier ring.

2. An apparatus comprising:

(a) a container having a container body and a cylindrical neck of smaller diameter than that of the container body, and a circular support ring located above the neck and having a diameter larger than that of said neck;

(b) a container carrier comprising: a flat, die cut plastic carrier comprising an endless band; said endless band including a carrier ring, a handle having an inner edge facing said carrier ring, and a pair of arms connecting said handle to said carrier ring; said carrier ring having an elliptical opening therein having a major axis with a length of about 1.4 inches and a minor axis with a length of about 1.1 inches said arms being connected to said carrier ring adjacent to the ends of the minor axis of said elliptical opening, the connection area of said arms to said carrier ring including an inner edge facing said handle and merging into the handle inner edge, and including an outer edge facing away from said handle, and wherein the radius of curvature of said inner edge is substantially greater than that of said outer edge, to equalize stress risers in said connection area; said handle having a groove extending along substantially its entire length; and a break-away connecting tab connecting a mid-portion of said handle to said carrier ring; and (c) said carrier being attached to said container with said carrier ring surrounding said neck below said support ring and being oriented in a radial plane transverse to said container.

* * * * *